US008419239B2

(12) United States Patent
Chen

(10) Patent No.: US 8,419,239 B2
(45) Date of Patent: Apr. 16, 2013

(54) COLOR LED LAMP HAVING LIGHT DIFFUSING MEMBER AND HOLLOW ISOLATION MEMBER WITH CONCENTRIC OPTICAL CHANNELS

(75) Inventor: Xiang-Yan Chen, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 252 days.

(21) Appl. No.: 12/909,787

(22) Filed: Oct. 21, 2010

(65) Prior Publication Data

US 2011/0188245 A1 Aug. 4, 2011

(30) Foreign Application Priority Data

Feb. 4, 2010 (CN) ..... 2010 1 0301202

(51) Int. Cl.
*F21V 29/00* (2006.01)

(52) U.S. Cl.
USPC .. 362/373; 362/294; 362/249.02; 362/311.02

(58) Field of Classification Search ..... 362/231, 362/249.02, 294, 373, 311.02, 290
See application file for complete search history.

(56) References Cited

U.S. PATENT DOCUMENTS

| | | | | |
|---|---|---|---|---|
| 6,474,837 | B1 | 11/2002 | Belliveau | |
| 7,914,162 | B1 * | 3/2011 | Huang | 362/92 |
| 7,963,665 | B2 * | 6/2011 | Minoda et al. | 362/231 |
| 8,016,458 | B2 * | 9/2011 | Liu et al. | 362/294 |
| 2009/0213585 | A1 * | 8/2009 | Chern et al. | 362/231 |
| 2009/0237933 | A1 * | 9/2009 | Liu | 362/249.02 |

* cited by examiner

*Primary Examiner* — Robert May
(74) *Attorney, Agent, or Firm* — Altis Law Group, Inc.

(57) ABSTRACT

A color LED lamp includes a lamp holder, a heat dissipating module, a light source module, an optical convergence element, and a positioning sleeve. The light source module includes an isolation member. The isolation member is arranged between light-emitting diodes and a light diffusing member. The isolation member is hollow and made of reflecting material, the space inside the isolation member is divided into a number of optical channels along the axial direction by a number of partitions, each of the optical channels corresponds to one group of light-emitting diodes, and allows the light emitted from the group of light-emitting diodes to pass through.

8 Claims, 6 Drawing Sheets

COLOR LED LAMP HAVING LIGHT DIFFUSING MEMBER AND HOLLOW ISOLATION MEMBER WITH CONCENTRIC OPTICAL CHANNELS

TECHNICAL FIELD

The present disclosure relates to light-emitting diode (LED) lamps, especially, to a color LED lamp.

DESCRIPTION OF RELATED ART

A light-emitting diode (LED) lamp usually emits single color light. To manufacture a multi-color LED lamp, a number of LED modules are needed, which adds to the cost of the LED lamp.

BRIEF DESCRIPTION OF THE DRAWINGS

The components of the drawings are not necessarily drawn to scale, the emphasis instead being placed upon clearly illustrating the principles of a color LED lamp. Moreover, in the drawings, like reference numerals designate corresponding parts throughout several views.

DETAILED DESCRIPTION

Figure 1:
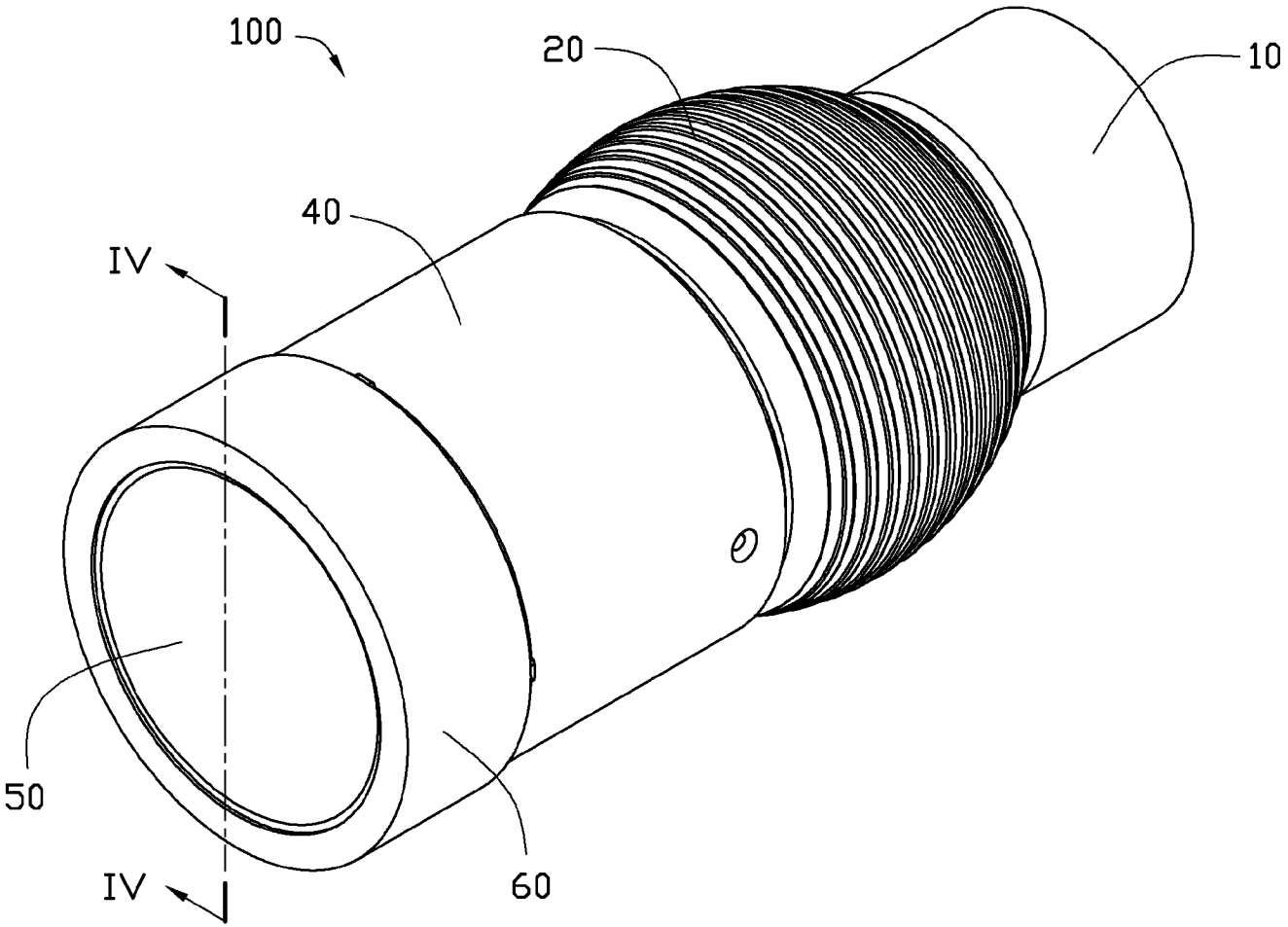
FIG. 1 is an isometric, assembled view of a multi-color LED lamp according to an exemplary embodiment.
Figure 2:
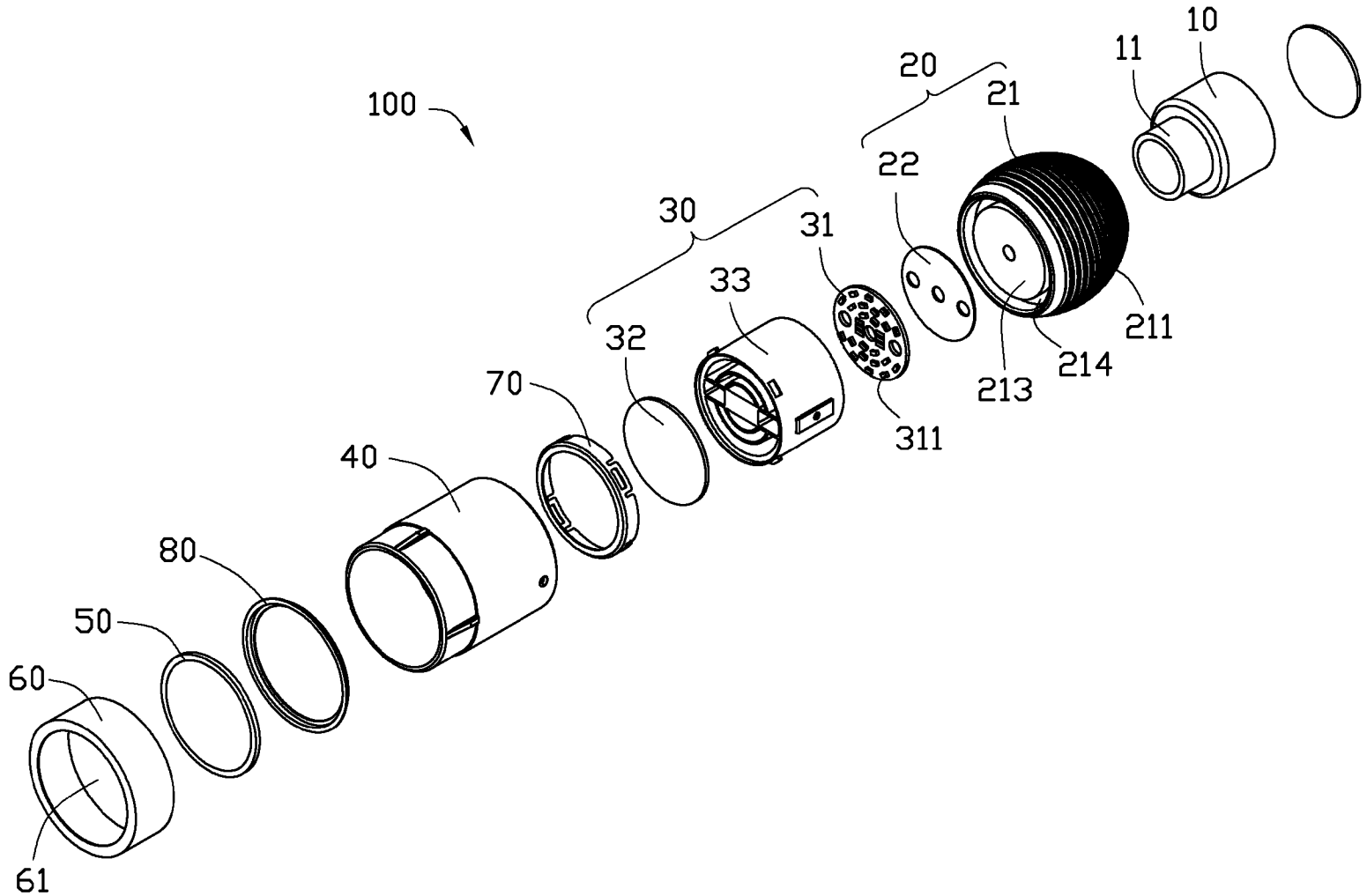
FIG. 2 is an exploded view of the multi-color LED lamp in FIG. 1.
Figure 3:
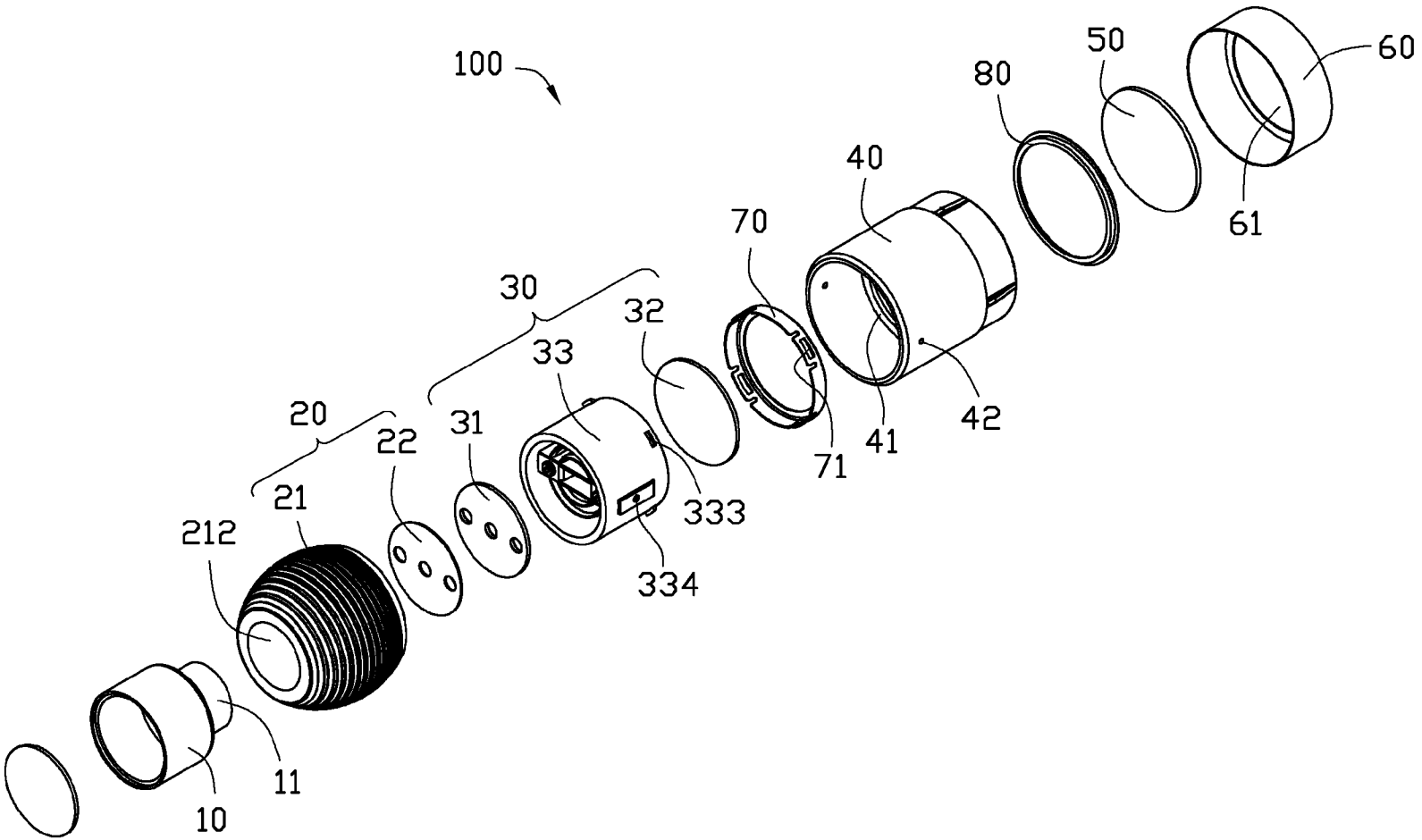
FIG. 3 is another exploded view of the multi-color LED lamp of FIG. 1 from another viewpoint.
Figure 4:
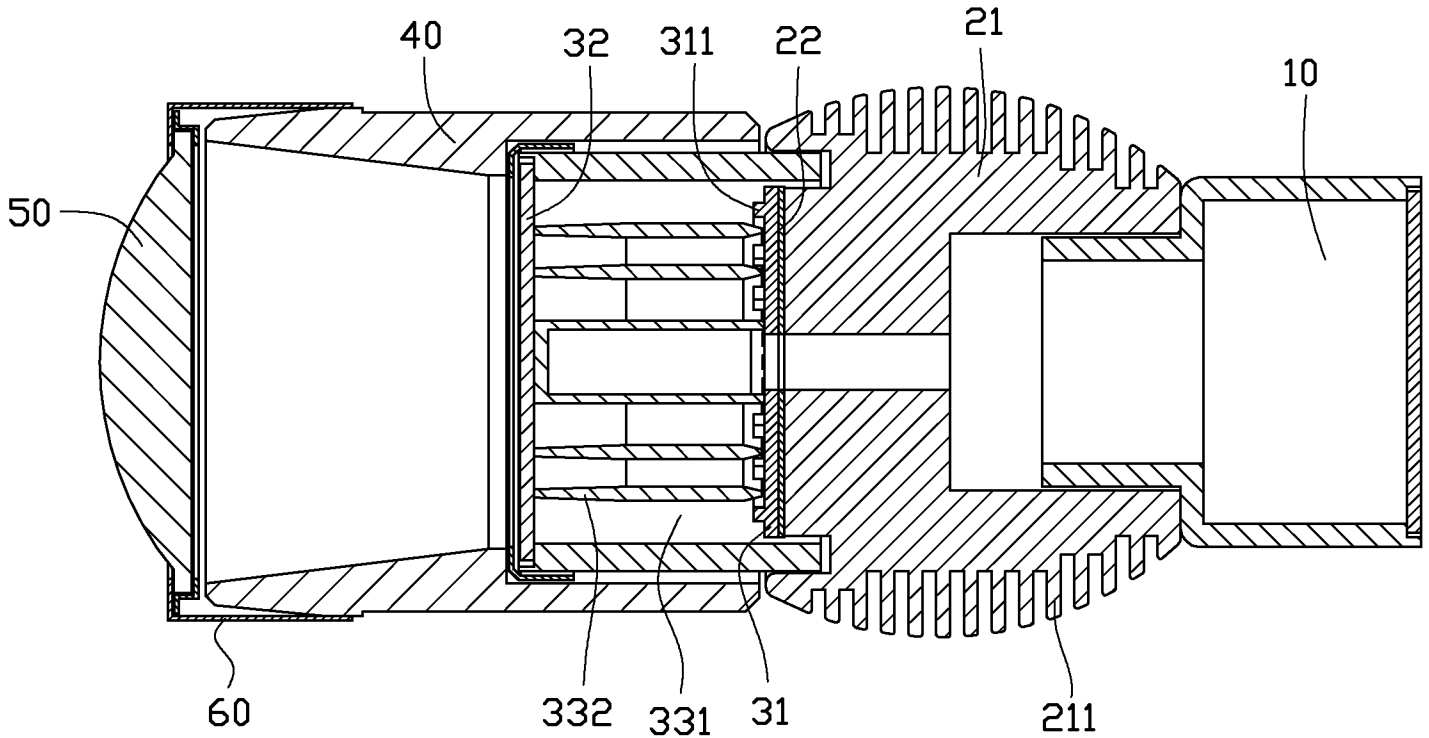
FIG. 4 is a cross-sectional view of the LED lamp of FIG. 1, taken along line IV-IV of FIG. 1.

Referring to FIGS. 1-5, a color LED lamp 100 according to an exemplary embodiment includes a lamp holder 10, a heat dissipating module 20, a light source module 30, a positioning sleeve 40, an optical convergence element 50, and a lampshade 60.

The lamp holder 10 is hollow and includes a base and a projecting portion 11 protruding from the base.

The heat dissipating module 20 includes a body 21 and a heat-dissipating glue layer 22. In this embodiment, the body 21 is drum-shaped. The heat-dissipating glue layer 22 is fixed on an end face 213 of the body 21 away from the lamp holder 10. An annular groove 214 is formed in the end face 213. The heat dissipating module 20 also includes a number of fins 211 arranged around the body 21.

A mounting chamber 212 is formed in another end of the body 21 and is used to accommodate the projecting portion 11 of the lamp holder 10. A gap existing between the projecting portion 11 and the mounting chamber 212 is filled with glue to connect the lamp holder 10 to the body 21.

The light source module 30 includes a substrate 31, a light diffusing member 32, and an isolation member 33. One end surface of the substrate 31 is adhered to the heat-dissipating glue layer 22, and the opposite end surface of the substrate 31 includes a number of light-emitting diodes 311. The light-emitting diodes 311 are divided into a number of groups, and at least two groups emit two different colors of light rays.

Figure 5:
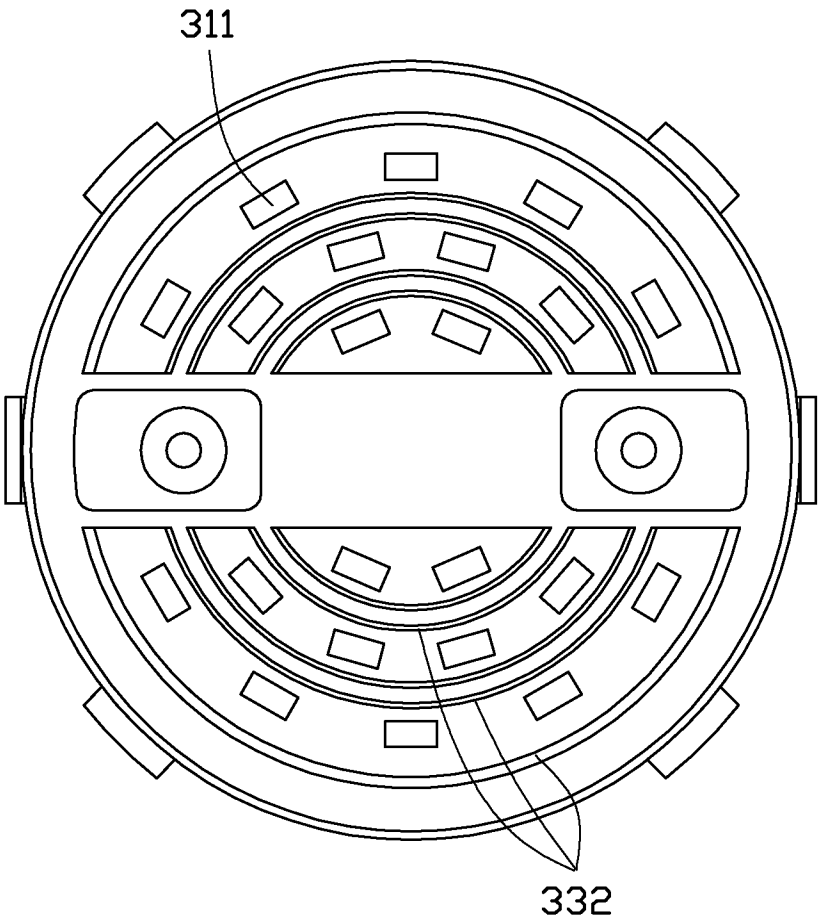
FIG. 5 is a schematic view of groups of light-emitting diodes and an isolation member assembled together for the multi-color LED lamp of FIG. 1.

Referring also to FIG. 5, in this embodiment, the groups of light-emitting diodes 311 are arranged to form a number of concentric rings.

The isolation member 33 is hollow and made of material with a reflectivity not less than 0.7. In this embodiment, the isolation member 33 is a hollow cylinder and arranged between the light-emitting diodes 311 and the light diffusing member 32. The end of the isolation member 33 facing the body 21 is received in the annular groove 214. The external lateral surface of the isolation member 33 defines a number of protruding tabs 333 at one end, and at least two threaded holes 334 in a middle position.

The space inside the isolation member 33 is divided into a number of optical channels 331 along an axial direction of the isolation member 33 by a number of walls 332. In the embodiment, the walls 332 are concentric. Each of the optical channels 331 corresponds to one group of light-emitting diodes 311, and allows the light rays emitted from the group of light-emitting diodes 311 to pass through. Therefore the light rays from different groups of light-emitting diodes 311 can independently pass through the optical channels 331.

The color LED lamp 100 also includes a retaining ring 70. The retaining ring 70 is arranged on one end of the isolation member 33. The light diffusing member 32 is arranged between the isolation member 33 and the retaining ring 70. The light diffusing member 32 is configured for diverging light from the plurality of groups of light-emitting diodes. The retaining ring 70 is a shallow cup and defines two slots 71 in its external lateral surfaces. Two of the protruding tabs 333 extend through the slots 71, respectively, to fix the light diffusing member 32 to the isolation member 33.

The positioning sleeve 40 is used for clamping the optical convergence element 50 to the light source module 30. The positioning sleeve 40 defines a stepped hole along its longitudinal direction, which forms an annular shoulder 41. The isolation member 33 is partly received in the positioning sleeve 40, and one end face of the retaining ring 70 resists against the shoulder 41. At least two threaded holes 42 are defined in the lateral surface of the positioning sleeve 40. A screw (not shown) can be screwed into the threaded holes 334 and 42 to fix the isolation member 33 and the positioning sleeve 40.

The optical convergence element 50 focuses light. In this embodiment, the convergence element 50 is an optical lens. A protective ring 80 is arranged between the convergence element 50 and the positioning sleeve 40, to protect the convergence element 50 from being damaged by the positioning sleeve 40. The lampshade 60 is a hollow cylinder and defines a through opening 61 that allows the convergence element 50 to partly extend through. The lampshade 60 is arranged around the positioning sleeve 40.

Figure 6:
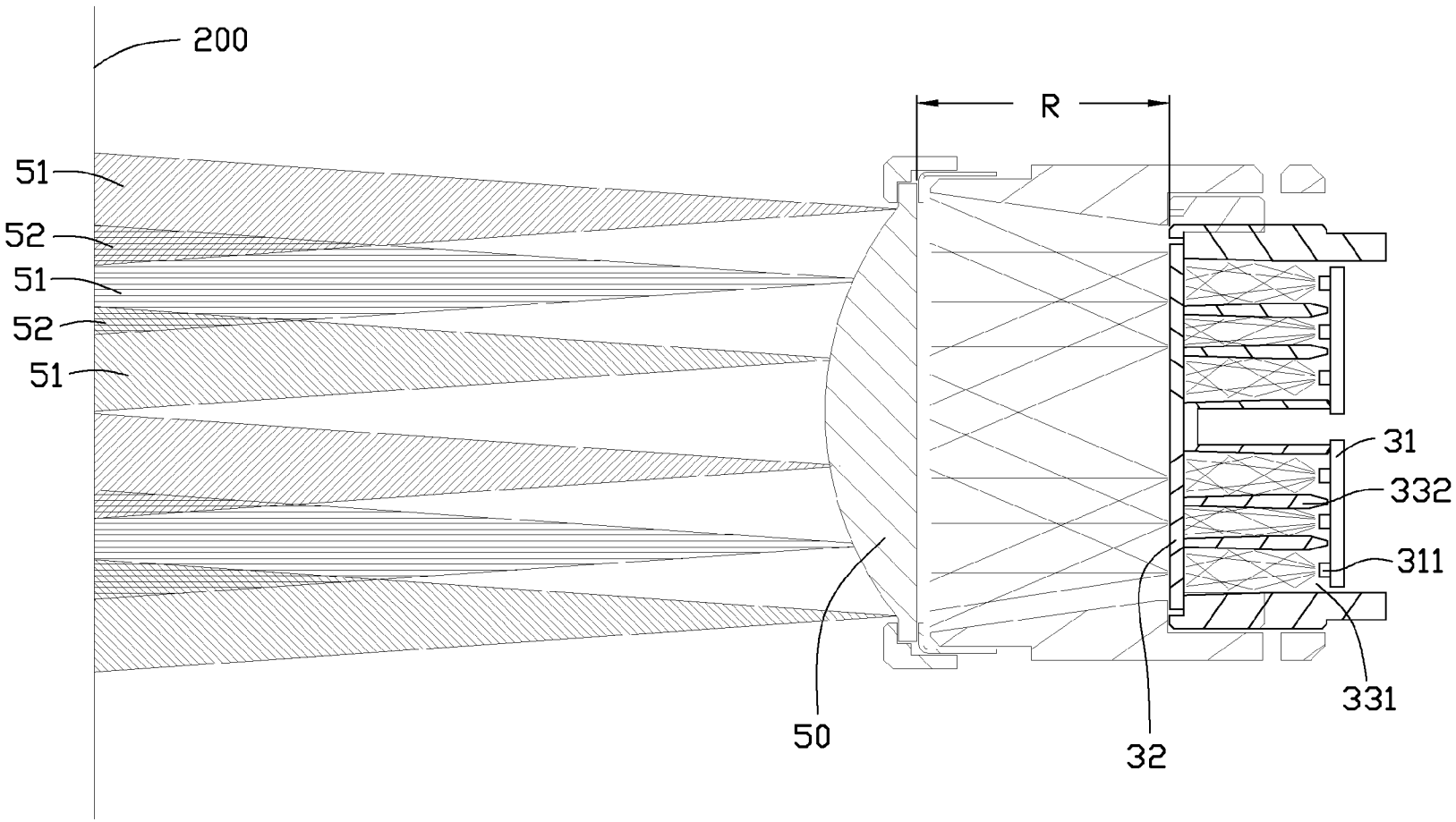
FIG. 6 is a schematic view illustrating the light paths of the multi-color LED lamp.

Referring to FIG. 6, a number of groups of light rays emitted by the groups of light-emitting diodes 311 respectively pass through the corresponding optical channels 331. Each group of light rays is reflected by the walls 332 to the light diffusing member 32. After passing through the light diffusing member 32, light rays within each group diverge and mix with rays from adjacent or different groups and are projected to the optical lens 50.

After the mixed rays pass through the optical lens 50, a number of single color areas 51 and color mixing areas 52 are visibly formed on a surface 200.

In another embodiment, the distance R between the light diffusing member 32 and the lens 50 may be adjusted to cause the groups of rays not to mix, such that a number of light areas in the form of concentric rings can be formed on the surface 200.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A color LED lamp comprising:

a lamp holder;

a heat dissipating module fixed to the lamp holder, and a light source module comprising:

a substrate fixed to the heat dissipating module and comprising a plurality of groups of light-emitting diodes arranged to form a plurality of concentric rings, wherein at least two groups emit two different colors of light rays;

a hollow isolation member made of reflecting material and arranged facing the light-emitting diodes, wherein the space inside the isolation member is divided into a number of optical channels having coaxial walls that extend along a longitudinal axial direction of the isolation member wherein the spaces between the adjacent walls are optical channels distributed in concentric rings each corresponding to one of each concentric ring of light-emitting diodes and allows the light rays emitted from the group of light-emitting diodes to pass through;

a light diffusing member attached to the surface of the isolation member away from the light-emitting diodes, and configured for diverging light rays from the optical channels, and mix the light rays from different groups of the light-emitting diodes;

a hollow positioning sleeve attached to the isolation member;

a hollow lampshade arranged around the positioning sleeve away from the isolation member, and defining a through opening; and an optical convergence element arranged between the position sleeve and the lampshade, partly extending through the opening, and configured for focusing the mixed light rays from the light diffusing member.

2. The color LED lamp of claim 1, wherein the reflectivity of the material of the isolation member is not less than 0.7.

3. The color LED lamp of claim 1, wherein the color LED lamp also comprises a protective ring arranged between the convergence element and the positioning sleeve, to protect the convergence element from being damaged by the positioning sleeve.

4. The color LED lamp of claim 1, wherein the convergence element is an optical lens.

5. The color LED lamp of claim 1, wherein the color LED lamp also comprises a retaining ring arranged on one end of the isolation member, and the light diffusing member is arranged between the isolation member and the retaining ring.

6. The LED lamp of claim 5, wherein a stepped hole is defined along longitudinal direction of the positioning sleeve, which forms an annular shoulder, the isolation member is partly received in the positioning sleeve, and one end face of the retaining ring resists against the shoulder.

7. A light source module comprising:

a substrate comprising a plurality of groups of light-emitting diodes arranged to form a plurality of concentric rings, wherein at least two groups emit two different colors of light rays;

a hollow isolation member made of reflecting material and arranged facing the light-emitting diodes, wherein the space inside the isolation member is divided into a number of optical channels having coaxial walls that extend along a longitudinal axial direction of the isolation member wherein the spaces between the adjacent walls are optical channels distributed in concentric rings each corresponding to one of each concentric ring of light-emitting diodes and allows the light rays emitted from the group of light-emitting diodes to pass through; and a light diffusing member attached to the surface of the isolation member away from the light-emitting diodes, and configured for diverging light rays from the optical channels, and mix the light rays from different groups of the light-emitting diodes.

8. The light source module of claim 7, wherein the reflectivity of the material of the isolation member is not less than 0.7.

* * * * *